US010125966B2

(12) United States Patent
Lee et al.

(10) Patent No.: US 10,125,966 B2
(45) Date of Patent: Nov. 13, 2018

(54) LIGHT EMITTING DIODE LAMPS WITH HEAT-DISPERSING CONSTRUCTION AND MECHANISM

(71) Applicant: SHUNSIN TECHNOLOGY (ZHONG SHAN) LIMITED, Zhongshan (CN)

(72) Inventors: Shun-Long Lee, New Taipei (TW); Wen-Hsiang Wu, New Taipei (TW)

(73) Assignee: SHUNSIN TECHNOLOGY (ZHONG SHAN) LIMITED, Zhongshan (CN)

( * ) Notice: Subject to any disclaimer, the term of this patent is extended or adjusted under 35 U.S.C. 154(b) by 120 days.

(21) Appl. No.: 15/183,963

(22) Filed: Jun. 16, 2016

(65) Prior Publication Data

US 2017/0284651 A1 Oct. 5, 2017

(30) Foreign Application Priority Data

Apr. 5, 2016 (CN) ..... 2016 2 0271987 U

(51) Int. Cl.
*F21K 9/275* (2016.01)
*F21V 29/75* (2015.01)
(Continued)

(52) U.S. Cl.
CPC ..... *F21V 29/75* (2015.01); *F21K 9/20* (2016.08); *F21K 9/275* (2016.08); *F21V 19/003* (2013.01);
(Continued)

(58) Field of Classification Search
CPC .. F21V 19/0025; F21V 19/003; F21V 19/004; F21V 19/0045; F21V 19/042; F21V 19/045; F21V 17/06; F21V 17/164; F21V 17/18; F21K 9/27; F21K 9/272; F21K 9/275; F21K 9/278; F21K 9/20; F21K 9/235
See application file for complete search history.

(56) References Cited

U.S. PATENT DOCUMENTS

2007/0109806 A1* 5/2007 Tsukamoto ..... F21S 48/1109 362/545
2009/0296381 A1* 12/2009 Dubord ..... F21S 2/005 362/218
(Continued)

FOREIGN PATENT DOCUMENTS

CN 201615377 U 10/2010
CN 203297983 U 11/2013

*Primary Examiner* — Anh Mai
*Assistant Examiner* — Steven Horikoshi
(74) *Attorney, Agent, or Firm* — ScienBiziP, P.C.

(57) ABSTRACT

An LED lamp with a built-in means of dissipating working heat includes top and bottom covers, a connector between the two, and an integrated device which is received by the top and bottom covers. The integrated device includes a radiator, a control circuit, and a plurality of LED chips. The control circuit and LED chips are disposed on the main surface and are electrically connected to the control circuit. One end of the connector is electrically connected to an external power source and the other end of the connector supplies power to the LED chips. The LED lamp being integrated with a radiator device, a control circuit, and an illumination device, the lighting efficiency and working life of the LED chip is improved.

10 Claims, 4 Drawing Sheets

(51) Int. Cl.

| | |
|---|---|
| ***F21K 9/20*** | (2016.01) |
| *F21V 19/00* | (2006.01) |
| *F21V 29/76* | (2015.01) |
| *F21Y 115/10* | (2016.01) |

(52) U.S. Cl.
CPC ..... *F21V 29/763* (2015.01); *F21Y 2115/10* (2016.08)

(56) References Cited

U.S. PATENT DOCUMENTS

| | | | | |
|---|---|---|---|---|
| 2011/0044002 | A1* | 2/2011 | Jokelainen | C23C 4/10 361/704 |
| 2011/0090682 | A1* | 4/2011 | Zheng | F21V 23/006 362/218 |
| 2014/0043801 | A1* | 2/2014 | Kawabata | F21K 9/00 362/218 |
| 2015/0176770 | A1* | 6/2015 | Wilcox | F21K 9/175 362/224 |

* cited by examiner

LIGHT EMITTING DIODE LAMPS WITH HEAT-DISPERSING CONSTRUCTION AND MECHANISM

FIELD

The subject matter herein generally relates to the technical field of illumination, and more particularly to light emitting diode (LED) lamps.

BACKGROUND

An LED lamp mainly includes a transparent cover, a printed circuit board (PCB) received in the transparent cover, two lids positioned on the two ends of the transparent cover, and two groups of conductive connecting structure located on the two lids. The LEDs on the PCB generate and transmit light to the outside through the transparent cover. However, insufficient heat dispersal by radiation or other means can cause abnormal operation and a short working lifetime of the LED lamp.

BRIEF DESCRIPTION OF THE DRAWINGS

Implementations of the present technology will now be described with reference to the attached figures.

DETAILED DESCRIPTION

Figure 1:
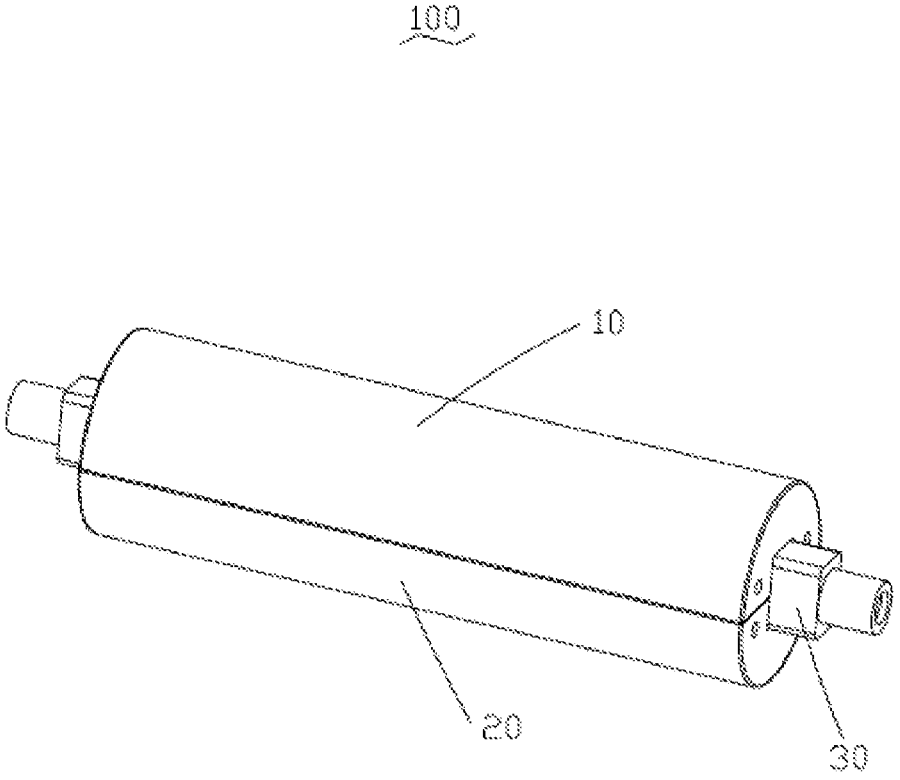
FIG. 1 is an assembled view of an LED lamp in accordance with an embodiment of the disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like reference numerals indicate the same or similar elements. It should be noted that references to "an" or "one" embodiment in this disclosure are not necessarily to the same embodiment, and such references can mean "at least one".

Figure 2:
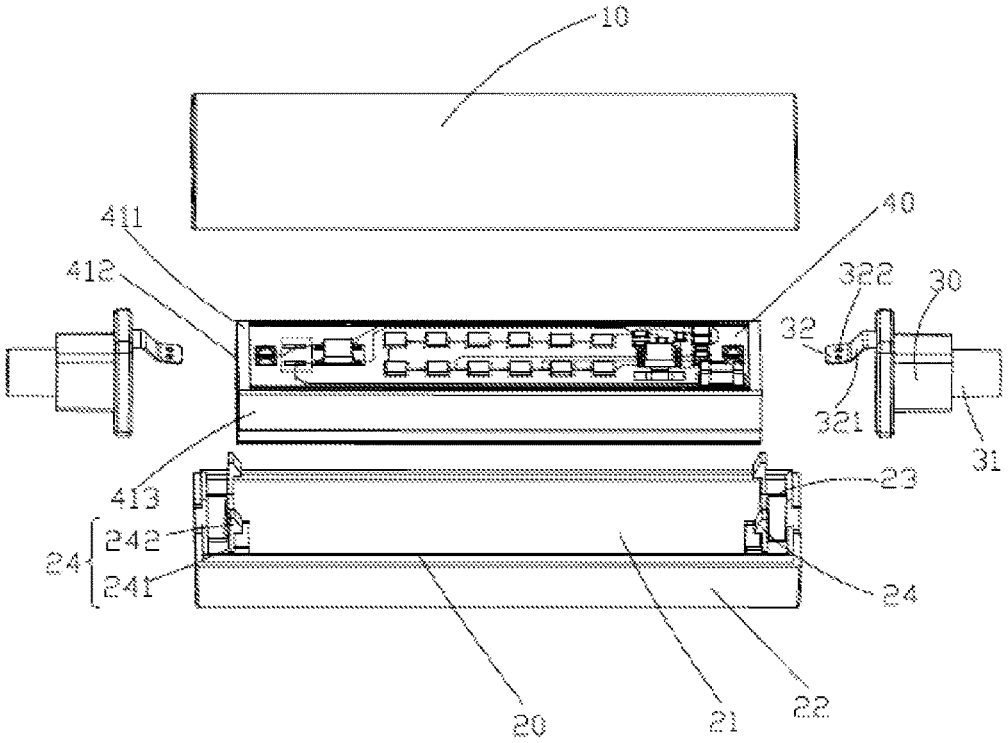
FIG. 2 is an exploded perspective view of the LED lamp shown in FIG. 1, the LED lamp comprises an integrated device, a bottom cover, and a connector.

FIG. 1 and FIG. 2 illustrate an LED lamp (lamp 100) which includes a top cover 10, a bottom cover 20 fastened to the top cover 10, a connector 30 fastened to the top cover 10 and the bottom cover 20, and an integrated device 40 received in a spaced defined by the top cover 10 and the bottom cover 20. The top cover 10 with a semi-circular cylindrical and transparent structure forms a first receiving space (not shown in the figures). The integrated device 40 is integrated with a heat-radiating device, a control circuit, and an illumination device and the control circuit is electrically connected to the external power source by the connector 30. The external power source supplies power for the illumination device, the light from the illumination device is transmitted through the top cover 10 to the outside, and the heat-radiating device works to dissipate heat from the illumination device. The working efficiency and the service life of the LED lamp is thereby improved.

The bottom cover 20 and the top cover 10 form a second receiving space 21 and a shell 22 surrounding the second receiving space 21. Two sides of the shell 22 extend toward to the second receiving space 21 to form two connection portions 23. Each connection portion 23 extends away from the shell sides to form a pair of latches 24. The latch 24 includes a combining part 241 connected with the connection portion 23 and a fastening part 242 extending from the combining part 241.

The connector 30 includes a body 31 and a spring 32. The body 31 spaced from one end of the spring is connected to the external power source, and the spring 32 is connected with the internal conductive structure in the body 31 to introduce the external power. The spring 32 includes a fastening piece 321 and the fastening piece 321 defines a mounting hole 322.

Figure 3:
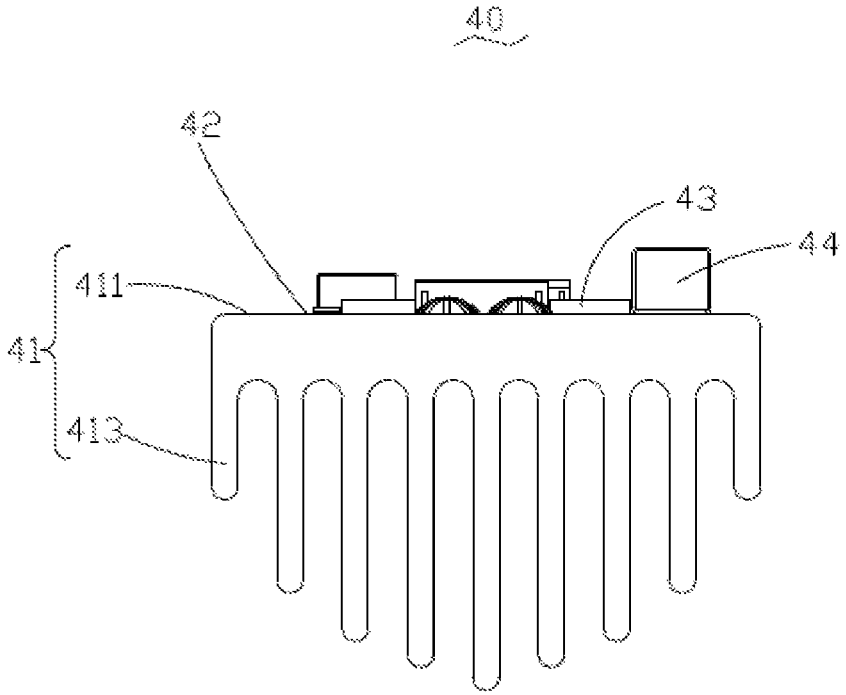
FIG. 3 is a perspective view of the integrated device in FIG. 2.
Figure 4:
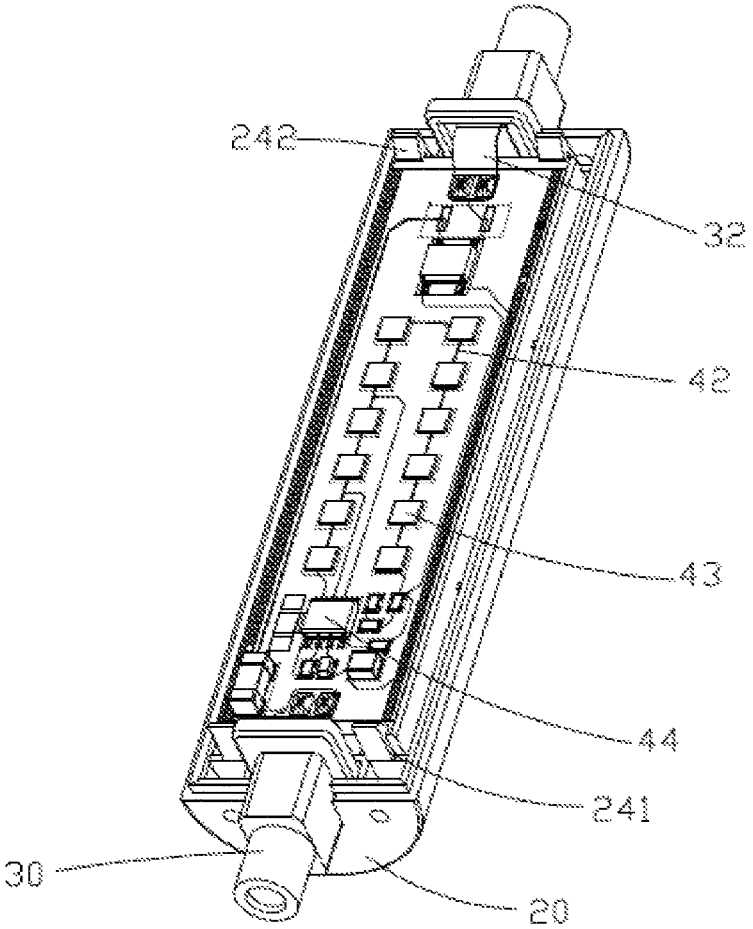
FIG. 4 is an assembled view of the integrated device, the bottom cover, and the connector in FIG. 2.

FIG. 2-4 illustrate the integrated device 40 received in the first receiving space and the second receiving space 21. The integrated device 40 includes a radiator 41, a control circuit 42, a plurality of LED chips 43, and a plurality of patch components 44.

The radiator 41 includes a main surface 411, a clamping end 412 located on both two sides of the main surface 411, and a plurality of radiating fins 413 formed from the main surface 411 and extending away from the main surface 411. The clamping end 412 is configured to correspond to the latch 24 of the bottom cover 20. The two sides of the bottom cover 20 have at least one latch 24 fastened to the clamping end 412, each clamping end 412 carries two latches. The plurality of radiating fins 413 is a convex and symmetrical structure. That is, each fin in the middle of the plurality of radiating fins are longer than the fins towards the ends of the plurality of radiating fins. The plurality of radiating fins 413 is received in the second receiving space 21 of the bottom cover 20.

The length of the combining part 241 of the latch 24 is equal to the thickness of the side of the radiator 41.

Further, the fins of the plurality of radiating fins 413 may be other structures and shapes.

The control circuit 42 is disposed on the main surface 411 of the radiator 41. In the embodiment, the control circuit 42 can be disposed on the main surface 411 by thick film printing technology or other effective technology.

The plurality of patch elements 44 are electrically interconnected with the control circuit 42 and the plurality of LED chips 43. The plurality of LED chips 43 and patch components 44 are assembled on the main surface 411 and electrically connected with the control circuit 42. The plurality of LED chips 43 is sequentially and equidistantly disposed on the main surface 411, and electrically connected with the patch components 44 by the control circuit 42. The heat produced by the LED chips 43 and patch components 44 is dissipated directly by the plurality of radiating fins 413, the distribution of elements brings out better heat dissipation and reduces the size of the LED lamp. In the embodiment, the number of the LED chips 43 is twelve, and the LED chips are assembled in two rows on the main surface 411. In other embodiments, the number of the LED chips 43 can be adjusted according to the actual requirements.

The patch component 44 can be a controller for lamp, or a processor or the like. The connector 30 is fastened to the clamping end 412 and located between the two latches 24. The fastening piece 321 of the spring 32 and a fastener such as a screw are fixed on the clamping end 412 by the mount hole 322, and are electrically connected to the control circuit 42. The spring 32 is fixed on the clamping end 412 and is positioned near the latch 24. One end of the connector is coupled to an external power source and the other end of the connector is coupled to the control circuit. The connecter 30 supplies power for the LED chips 23 when connected with the external power source, and illuminates the LED chips 23. The heat produced by the LED chips 43 and patch components 44 is dispersed to the outside air by the plurality of radiating fins 413.

The LED lamps described in the embodiments are integrated with the radiator 41, the control circuit 42, and the LED chips 43 by the integrated device 40.

Many details are often found in the art such as the other features of an LED lamp. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An LED lamp comprising:

a top cover;

a bottom cover fastened to the top cover;

a connector fastened to the top cover and the bottom cover; and an integrated device received by the top cover and the bottom cover, the integrated device comprising a radiator, a control circuit and a plurality of LED chips, wherein the control circuit is disposed on a main surface of the radiator, the plurality of LED chips are disposed on the main surface and coupled to the control circuit, one end of the connector is configured to be coupled to an external power and the other end of the connector is coupled to the control circuit for power supplying to the plurality of LED chips, two connection portions respectively extend from two sides of the bottom cover, and a pair of latches extend from each of the two connection portions, the connector comprises a body and a spring, the body is entered into each of the two connection portions, the spring is fixed on the radiator and is positioned between the pair of latches, and the latches and the spring engage a same side of the integrated device.

2. The LED lamp of claim 1, wherein the radiator comprises a clamping end positioned on two sides of the main surface, and the pair of latches are fastened to the clamping end.

3. The LED lamp of claim 2, wherein the radiator further comprises a plurality of radiating fins extending downward from the main surface, and the plurality of radiating fins of the radiator are received in the bottom cover.

4. The LED lamp of claim 3, wherein the plurality of radiating fins are a convex and symmetrical structure, each fin in the middle of the plurality of the radiating fins are longer than the fins towards the ends of the plurality of the radiating fins.

5. The LED lamp of claim 1, wherein the pair of latches each comprises a combining part connected with each of the two connection portions and a fastening part extending from the combining part, and the length of the combining part of the latch is equal to a thickness of the side of the radiator.

6. The LED lamp of claim 1, wherein the body spaced from one end of the spring is configured to be connected to the external power, and the body is coupled to the control circuit for power supplying by the spring.

7. The LED lamp of claim 1, wherein the integrated device further comprises a plurality of circuit elements assembled on the main surface of the radiator, the plurality of circuit elements are electricity interconnected with the control circuit and the plurality of LED chips.

8. The LED lamp of claim 1, wherein the top cover is a semi-circular cylindrical and transparent structure.

9. The LED lamp of claim 8, wherein the bottom cover is configured corresponding to the top cover to form a receiving space to receive the integrated device.

10. The LED lamp of claim 1, wherein the control circuit is disposed on the main surface by thick film printing.

* * * * *